US010582754B2

(12) United States Patent
Delia et al.

(10) Patent No.: US 10,582,754 B2
(45) Date of Patent: Mar. 10, 2020

(54) COSMETIC CONTAINER

(71) Applicant: Toly Management Ltd., Zejtun ZTN (MT)

(72) Inventors: Mario Delia, Zabbar (MT); Shipra Kukreja, New Delhi (IN)

(73) Assignee: TOLY MANAGEMENT LTD., Zejtun (MT)

( * ) Notice: Subject to any disclaimer, the term of this patent is extended or adjusted under 35 U.S.C. 154(b) by 75 days.

(21) Appl. No.: 15/905,393

(22) Filed: Feb. 26, 2018

(65) Prior Publication Data

US 2018/0255906 A1 Sep. 13, 2018

(30) Foreign Application Priority Data

Mar. 8, 2017 (IN) ..... 201711008099

(51) Int. Cl.

*A45D 40/12* (2006.01)
*A45D 40/00* (2006.01)
*A45D 40/16* (2006.01)

(52) U.S. Cl.

CPC ..... *A45D 40/00* (2013.01); *A45D 40/16* (2013.01); *A45D 2040/0025* (2013.01)

(58) Field of Classification Search

CPC ..... A45D 40/12; A45D 2040/0062
USPC ..... 401/88, 98
See application file for complete search history.

(56) References Cited

U.S. PATENT DOCUMENTS 1,852,455 A 4/1932 Friedman
3,332,429 A 7/1967 Bates
4,728,210 A 3/1988 Barish et al.
5,326,185 A 7/1994 Dornbusch
5,738,123 A 4/1998 Szekely
5,799,667 A 9/1998 Szekely
6,193,427 B1 2/2001 Benguigui
7,025,520 B2 4/2006 Petit
D534,076 S 12/2006 Green et al.
D564,900 S 3/2008 Green et al.
D573,026 S 7/2008 Tsai
(Continued)

FOREIGN PATENT DOCUMENTS

CN 103653686 3/2014
CN 203676394 7/2014
(Continued)

OTHER PUBLICATIONS http://derstandard.at/2000055323393/Lippenpflege-Contest-Eos-vs-Labellino-Was-fuer-ein-Eiertanz.
(Continued)

*Primary Examiner* — David J Walczak
*Assistant Examiner* — Joshua R Wiljanen
(74) *Attorney, Agent, or Firm* — Wissing Miller LLP

(57) ABSTRACT

A cosmetic container including a cap, a base, and a product holder in the base for holding a solid cosmetic product. The product holder includes an outer hollow body with an open upper end and a lower end; and a cantilevered member. At least a portion of the cantilevered member is arranged in an inner side of the outer hollow body and extends from the lower end of the outer hollow body. The cantilevered member further includes a connecting portion, and a hollow holder portion for holding the solid cosmetic product. The solid cosmetic product includes cosmetic or care products such as for example lip balm, cheek rouge or the like.

23 Claims, 14 Drawing Sheets

(56) References Cited

U.S. PATENT DOCUMENTS

| | | | |
|---|---|---|---|
| D581,280 | S | 11/2008 | Oates |
| D592,064 | S | 5/2009 | Kilany |
| D612,245 | S | 3/2010 | Puigbo |
| D625,469 | S | 10/2010 | Dubitsky et al. |
| D631,204 | S | 1/2011 | Dubitsky et al. |
| D644,939 | S | 9/2011 | Teller |
| D650,280 | S | 12/2011 | de Peyerimhoff |
| D651,903 | S | 1/2012 | Teller |
| D681,278 | S | 4/2013 | Schlatter |
| 8,444,337 | B2 | 5/2013 | Teller |
| 8,651,308 | B1 | 2/2014 | Sung |
| D708,790 | S | 7/2014 | Schlatter |
| D708,791 | S | 7/2014 | Schlatter |
| D709,652 | S | 7/2014 | Teller |
| D710,544 | S | 8/2014 | Shen |
| 8,888,391 | B2 | 11/2014 | Teller et al. |
| D726,028 | S | 4/2015 | Thompson |
| D732,240 | S | 6/2015 | Brown |
| 9,060,586 | B1 | 6/2015 | Erickson et al. |
| D733,563 | S | 7/2015 | Oberlender |
| D733,967 | S | 7/2015 | Schlatter |
| D734,550 | S | 7/2015 | Schlatter |
| D734,894 | S | 7/2015 | Schlatter |
| D735,413 | S | 7/2015 | Smith et al. |
| D735,414 | S | 7/2015 | Schlatter |
| D735,415 | S | 7/2015 | Thompson |
| 9,232,844 | B2 | 1/2016 | Thompson |
| D752,291 | S | 3/2016 | Schlatter |
| 9,314,086 | B2 | 4/2016 | Pires et al. |
| D758,867 | S | 6/2016 | Tsai |
| D762,329 | S | 7/2016 | Teller et al. |
| D763,512 | S | 8/2016 | Teller et al. |
| D764,105 | S | 8/2016 | Teller et al. |
| D764,106 | S | 8/2016 | Teller et al. |
| D764,107 | S | 8/2016 | Teller et al. |
| D764,108 | S | 8/2016 | Teller et al. |
| D764,109 | S | 8/2016 | Teller et al. |
| D764,110 | S | 8/2016 | Teller et al. |
| D764,111 | S | 8/2016 | Teller et al. |
| D764,112 | S | 8/2016 | Teller et al. |
| D764,113 | S | 8/2016 | Teller et al. |
| D764,114 | S | 8/2016 | Teller et al. |
| D764,710 | S | 8/2016 | Teller et al. |
| D764,711 | S | 8/2016 | Teller et al. |
| D764,713 | S | 8/2016 | Teller et al. |
| D764,714 | S | 8/2016 | Teller et al. |
| D766,512 | S | 9/2016 | Teller et al. |
| D770,685 | S | 11/2016 | Teller et al. |
| D771,495 | S | 11/2016 | Buogo et al. |
| D771,873 | S | 11/2016 | Teller |
| D772,481 | S | 11/2016 | Paquet |
| D775,426 | S | 12/2016 | Huff |
| D775,959 | S | 1/2017 | Owen et al. |
| D777,983 | S | 1/2017 | Teller et al. |
| D778,503 | S | 2/2017 | Teller |
| D779,737 | S | 2/2017 | Salmon |
| 9,585,458 | B2 | 3/2017 | Teller et al. |
| D787,741 | S | 5/2017 | Paquet |
| 9,775,423 | B2 | 10/2017 | Pires et al. |
| 9,924,776 | B2 | 3/2018 | Schlatter |
| 9,955,768 | B1 | 5/2018 | McGraw |
| 2013/0341833 | A1 | 12/2013 | Teller |
| 2015/0037082 | A1 | 2/2015 | Pires |
| 2015/0230584 | A1 | 8/2015 | Erickson |
| 2016/0192762 | A1 | 7/2016 | Pires |
| 2016/0262522 | A1 | 9/2016 | Teller et al. |
| 2016/0295993 | A1 | 10/2016 | Wojcik et al. |
| 2016/0295994 | A1 | 10/2016 | Liu |
| 2017/0013935 | A1 | 1/2017 | Schlatter et al. |
| 2017/0013936 | A1 | 1/2017 | Schlatter et al. |
| 2017/0215552 | A1* | 8/2017 | Keller ..... A45D 40/0068 |
| 2017/0325568 | A1 | 11/2017 | Teller et al. |
| 2018/0206614 | A1 | 7/2018 | Lushefski |
| 2018/0255906 | A1 | 9/2018 | Delia |
| 2018/0296460 | A1 | 10/2018 | Wong |
| 2018/0332948 | A1 | 11/2018 | Kaplan |
| 2019/0047760 | A1 | 2/2019 | Teller |
| 2019/0053605 | A1 | 2/2019 | Facer |

FOREIGN PATENT DOCUMENTS

| | | |
|---|---|---|
| CN | 204378253 | 6/2015 |
| CN | 204467304 | 7/2015 |
| CN | 208388074 | 1/2019 |
| CZ | 29255 | 3/2016 |
| DE | 202010018183 | 7/2014 |
| DE | 202010018186 | 8/2014 |
| DE | 202010018187 | 8/2014 |
| DE | 202010018188 | 8/2014 |
| DE | 202010018264 | 3/2015 |
| DE | 202010018265 | 3/2015 |
| DE | 202010018266 | 3/2015 |
| DE | 202010018263 | 5/2015 |
| DE | 202010018314 | 7/2015 |
| DE | 202010018315 | 7/2015 |
| DE | 202010018308 | 8/2015 |
| DE | 202010018311 | 8/2015 |
| DE | 202010018355 | 11/2015 |
| DK | 201500028 | 5/2015 |
| DK | 201500029 | 5/2015 |
| DK | 201500030 | 5/2015 |
| DK | 201500096 | 9/2015 |
| DK | 201500097 | 9/2015 |
| DK | 201500098 | 9/2015 |
| DK | 201500099 | 9/2015 |
| DK | 201500031 | 2/2017 |
| EM | 001710245 | 5/2010 |
| EM | 01773664 | 10/2010 |
| EM | 2089532 | 8/2012 |
| EM | 001371645 | 5/2013 |
| EM | 2434407 | 3/2014 |
| EM | 2501478 | 7/2014 |
| EM | 2579789 | 11/2014 |
| EM | 3000363 | 2/2016 |
| EM | 3000421 | 2/2016 |
| EM | 3056720 | 4/2016 |
| EM | 3065911 | 4/2016 |
| EM | 3121813 | 5/2016 |
| EM | 3321272 | 7/2016 |
| EM | 3456359 | 11/2016 |
| EM | 3508837 | 12/2016 |
| EM | 3545870 | 12/2016 |
| EP | 2509461 | 10/2012 |
| EP | 3066952 | 9/2016 |
| EP | 3154393 | 4/2017 |
| EP | 3174427 | 6/2017 |
| EP | 3342311 | 7/2018 |
| EP | 3386344 | 10/2018 |
| EP | 3410888 | 12/2018 |
| ES | 1151710 | 5/2016 |
| ES | 1152585 | 6/2016 |
| ES | 1152586 | 6/2016 |
| ES | 1152609 | 6/2016 |
| FR | 2766339 | 9/1999 |
| FR | 2996431 | 4/2014 |
| FR | 3029756 | 6/2016 |
| FR | 3031887 | 7/2016 |
| FR | 3046922 | 7/2017 |
| FR | 3052344 | 12/2017 |
| FR | 3054416 | 2/2018 |
| FR | 3059215 | 6/2018 |
| FR | 3064898 | 10/2018 |
| JP | 2015231968 | 12/2015 |
| JP | 2016140476 | 8/2016 |
| JP | 3216463 | 5/2018 |
| KR | 101659288 | 7/2016 |
| PT | 11269 | 9/2016 |
| RU | 140104 | 4/2014 |
| WO | 2015101358 | 7/2015 |
| WO | 2016164527 | 10/2016 |
| WO | 2017195377 | 11/2017 |
| WO | 201819739 | 2/2018 |
| WO | 2018022938 | 2/2018 |

(56) References Cited

FOREIGN PATENT DOCUMENTS

| | | |
|---|---|---|
| WO | 201849039 | 3/2018 |
| WO | 201895871 | 5/2018 |
| WO | 2018209353 | 11/2018 |

OTHER PUBLICATIONS http://www.horizont.net/marketing/nachrichten/Eos-vs.-Beiersdorf-Wie-der-US-Lippenpflege-Hersteller-am-Marktfuehrer-Thron-von-Labello-saegt-156958.
Blistex applicator.
CVS Bee Hive applicator.
CVS Macaron applicator.

* cited by examiner

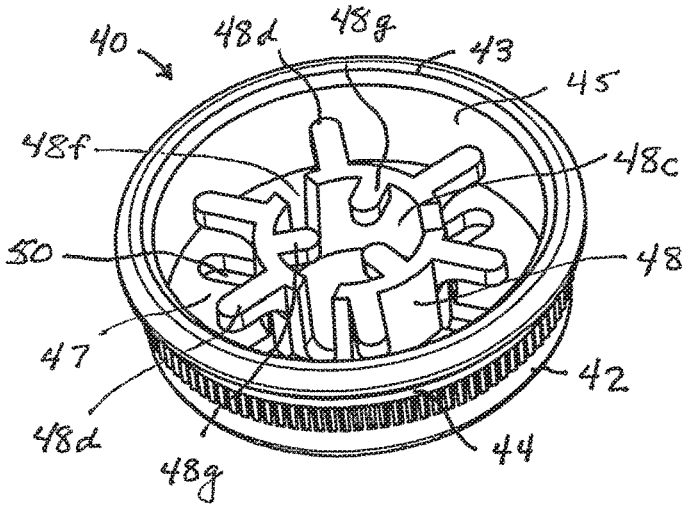
FIG. 5
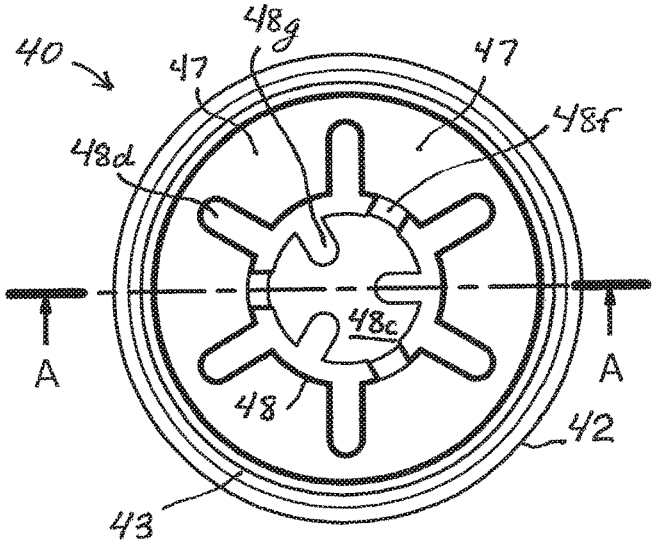
FIG. 6
FIG. 7
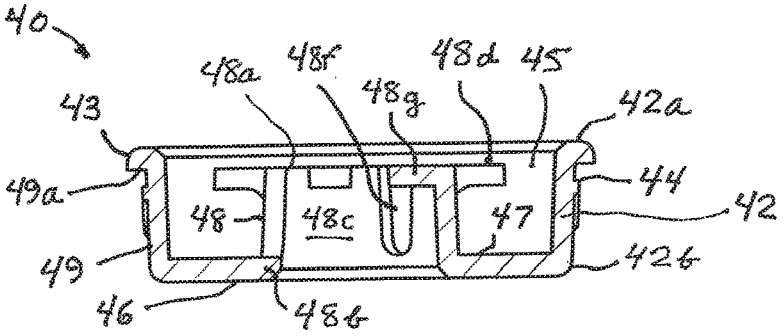

COSMETIC CONTAINER

CROSS REFERENCE TO RELATED APPLICATION

This application claims the priority benefit under 35 U.S.C. § 119(a) of Indian Provisional Patent Application No. 201711008099 filed Mar. 8, 2017, the entire disclosure of which is incorporated herein by this reference.

BACKGROUND OF THE INVENTION

The present disclosure generally relates to a cosmetic container structured to hold a solid cosmetic product, in particular cosmetic or care products such as for example lip balm, cheek rouge or the like.

Cosmetic products such as lip balms are currently sold as emulsions, liquids, gels, or solids. In emulsion or liquid form, the lip balms are generally packed in containers such as jars. Cosmetic compositions of this type are packaged in jars with a wide opening, which are closed with removable lids. For the user, this style of packaging has the disadvantage of having to withdraw a quantity of the product from the jar using the fingers, which entails soiling the fingernails. Moreover, withdrawal becomes less and less convenient as the quantity of product in the jar decreases. In addition, the general conditions of cleanliness and hygiene in which the product is used are not wholly satisfactory because the product itself, once opened, runs the risk of being contaminated in use.

Gels (and liquids on occasion) are typically dispensed from squeeze tubes. Solid lip balms are generally packaged in stick form and dispensable from tubes or from lipstick-type applicators.

U.S. Pat. No. 6,193,427 shows a cosmetic container with a solid cosmetic product having a dome shape. In the cosmetic container, if an external force, for example, an impact caused by a drop or the like, or a vibration or the like, is applied to the solid cosmetic material container, there is a risk that a crack or a chip is generated in the solid cosmetic material, and there is a risk that the solid cosmetic material breaks away from the container.

Recently, there has been known a cosmetic container that includes a product holder holding a solid cosmetic product having a dome-shaped convex portion; the product holder is installed in the base of the container in such a manner that a convex portion is protruded to an upper side, as shown, for example in U.S. Pat. Nos. 8,444,337 and 8,651,308. These product holders are designed to prevent a crack and a chip of a solid cosmetic product and prevent breaking away of the solid cosmetic product from the container, at a time when the external force, for example, the impact due to a drop or the like, or a vibration or the like, is applied.

There continues to be a need in the art for a cosmetic container with a product holder that is capable of resisting separation of the cosmetic product from the holder caused by mechanical shocks.

SUMMARY OF THE INVENTION

The present disclosure generally relates to a cosmetic container for storing a solid cosmetic product, in particular cosmetic or care products such as for example lip balm, cheek rouge or the like.

The term "solid cosmetic product" as used herein includes a solid or semi-solid product, for example lip balm, cheek rouge or the like which can be used for cosmetic or care applications.

According to an embodiment of the disclosure, there is provided a cosmetic container comprising a cap, a base and a product holder holding a solid cosmetic product in the base of the cosmetic container. The product holder includes an outer hollow body generally cylindrical in shape with an open upper end and a lower end; and a cantilevered member. At least a portion of the cantilevered member is arranged in an inner side of the outer hollow body.

According to an aspect of the present disclosure, the cantilevered member extends from the lower end of the outer hollow body into a space surrounded/enclosed by an inner surface of the outer hollow body.

According to another aspect of the present disclosure, the cantilevered member further includes at least one connecting portion, and a hollow holder portion for holding the solid cosmetic product, the hollow holder portion being coaxial with the outer hollow body.

According to yet another aspect of the present disclosure, the at least one connecting portion is arranged in a lower side of the outer hollow body for connecting the outer hollow body to the hollow holder portion. More particularly, the at least one connecting portion has one end connected to an open bottom end of the hollow holder portion and a second end connected to the lower end of the outer hollow body. According to yet another aspect of the present disclosure, the at least one connecting portion extends from at least a portion of the circumference of the lower end of the outer hollow body. According to yet another aspect of the present disclosure, two successive connecting portions define an aperture between them.

In another embodiment, the at least one connecting portion has lattice or mesh like structure having rigidity.

According to yet another aspect of the present disclosure, the hollow holder portion has an open top end and an open bottom end constituting a passage which is set as a filling port into which a liquefied cosmetic product is poured.

According to yet another aspect of the present disclosure, the hollow holder portion further includes a plurality of (i.e., at least two) projections projecting from the upper outer surface of the hollow holder portion. These projections project from the outer surface of an upper portion of the hollow holder portion in a radial or non-radial manner. The plural projections extend from the hollow holder portion towards the inner surface of the outer hollow body but they do not connect with or abut the inner surface of the outer hollow body. The plurality of projections of the hollow holder portion are structured to support/hold the cosmetic product and prevent the cracking or the chipping of the solid cosmetic product or prevent breaking away of the solid cosmetic product from the cosmetic container when an external force, for example, the impact due to a drop or the like, or a vibration or the like, is applied.

According to yet another aspect of the present disclosure, the at least two projections extending from the outer surface of the hollow holder portion are connected at their free ends by a connecting member which further improves anchoring of the solid cosmetic product with the product holder.

According to yet another aspect of the present disclosure, the hollow holder portion of the cantilevered member has at least one axial slit and at least one projection extending from an inner surface of the hollow holder portion. The at least one axial slit provides free flow of liquefied phase of the cosmetic product during a hot pour process and the at least one projection provides better anchoring of the solid cosmetic product with the product holder.

According to yet another aspect of the present disclosure, the cosmetic product is mounted on the product holder in the base and the cosmetic product is configured to have a dome shape. The dome shape allows the cosmetic product to extend above an upper edge of the outer hollow body of the product holder, thereby facilitating the uninhibited application of the cosmetic product when the product holder is mounted in the upper portion of the base. More particularly, the solid cosmetic product is structured to have an approximately cylindrical lower portion and a dome-shaped convex portion bulging upward from the lower portion. The present disclosure, however, is not limited to the cosmetic product being configured to have a dome shape as other configurations which allow the cosmetic product to extend above the upper edge of the outer hollow body of the product holder are within the scope of the present disclosure.

According to yet another aspect of the present disclosure, the outer hollow body is a stepped cylinder comprising an opening, an upper rim, and a contracted bottom mounting portion disposed axially below the upper rim. A bonding face is transversely disposed at the top side of the contracted bottom mounting portion. The upper rim has an outer diameter equal to an outer diameter of a neck of the base of the container whereas the contracted bottom mounting portion has an outer diameter less than the inner diameter of the neck of the base. Therefore, during mounting of the product holder in the base, the contracted bottom mounting portion is inserted into the base while the transverse bonding face is stopped on an upper edge of the neck of the base so that the upper rim is seated on the edge of the base.

Although the outer hollow body is described as being a substantially stepped cylindrical hollow body, the outer hollow body may not be stepped in other alternative embodiments of the present disclosure.

According to yet another aspect of the present disclosure, there is provided an external engagement feature on an exterior surface of the outer hollow body for engagement with the base. The external engagement feature on the outer hollow body includes a circumferential projection located on the contracted bottom mounting portion of the outer hollow body to facilitate the connection of the product holder to an interior connecting structure such as an annular groove in the interior of the base. In alternative embodiments, the circumferential projection may be located at any point along a length of the outer hollow body. In alternative embodiments, the base and the product holder may be connectable together via any suitable means known in the art. Further, the contracted bottom mounting portion may also comprise at least one weakened portion for providing flexibility to the contracted bottom mounting portion so that the product holder can be easily fitted into the base.

According to yet another aspect of the present disclosure, the cap and the base are separable from each other. The cap covers an upper portion of the base in such a manner as to cover the solid cosmetic product and the product holder holding the solid cosmetic product. Upon separation of the cap from the base, the cosmetic product is revealed. The cap and the base are preferably connectable together by screw threads although any other suitable attachment means such as a snap fitment, a j-lock or any other means known in the art may be employed. According to an alternative embodiment, the cap and the base may be connected by a hinge.

In another embodiment of the present disclosure, the neck of the base comprises external protrusions for attachment to the cap by co-operating with a circumferential groove provided in an interior surface of the cap.

According to yet another aspect of the present disclosure, the cosmetic product held by the product holder is manufactured using a hot pour process. In the hot pour process, cosmetic ingredients are combined and heated to form a liquefied phase and poured into a mold having a cavity shaped to provide a desired outer shape of the solid cosmetic product. In preparation for the hot pour process, the product holder is inverted and fitted to the mold having a shape corresponding to the upper shape of the cosmetic product. The product holder is level and vertical with regard to the mold. The heated and liquefied phase is poured into the product holder, preferably through the opening (filling port) of the hollow holder portion from a filling nozzle arranged in an upper side of the mold.

The heated and liquefied phase is poured into the mold and filled to a level to cover the plurality of projections and at least a portion of the hollow holder portion, and so as not to contact the connecting portion of the cantilevered member. The liquefied phase is allowed to cool. Upon sufficient solidification of the cosmetic product, the base is connected onto/upon the product holder. Alternatively, the base is connected onto the product holder when the cosmetic product is still in liquefied phase. Finally, when the cosmetic product is solidified, the mold is released, whereby the solid cosmetic product is supported by the product holder. The plurality of projections and connecting member provide surfaces onto which the solidified cosmetic product can adhere.

In a further alternative, the base has a bottom formed with a hole positioned for register with the filling port when the product holder is mounted in the base such that the base and product holder can be assembled together prior to hot pour molding of a cosmetic product.

In another alternative, at least one dividing wall extends transversely through the product holder to divide the product holder, including the hollow holder portion defining the filling port, into separate regions for enabling more than one product to be filled and molded thereon in the same cosmetic container.

According to yet another aspect of the present disclosure, the product holder is coupled to the base so as to be immobile in an axial direction.

A cosmetic container structured in the manner mentioned above may be used by detaching the cap from the base, holding the outer peripheral surface of the base and applying the dome-shaped convex portion of the cosmetic product to the skin. According to an alternative embodiment, the cap may be pivoted with respect to the base to open and close the cosmetic container.

The present invention is not limited in regard to the shape of the cosmetic container, as the container may be substantially cylindrical with rounded surfaces, egg-shaped, ovate, polygonal or the like. In the present embodiment, the cosmetic container comprises a cap and a base both having substantially semi-spherical shape; therefore the cosmetic container appears substantially spherical in shape.

According to an aspect of the present disclosure, the cap, the base, and product holder are constituted by plastic, glass, metal or any other material known in the art.

Further features and advantages of the invention will be apparent from the detailed description hereinafter set forth, together with the accompanying drawings.

BRIEF DESCRIPTION OF THE DRAWINGS

FIG. 5 is a perspective view of a product holder of the cosmetic container of FIG. 1;

FIG. 6 is a top view of the product holder of FIG. 5;

FIG. 7 is a cross sectional view of the product holder along line A-A of FIG. 6;

DETAILED DESCRIPTION

Figure 1:
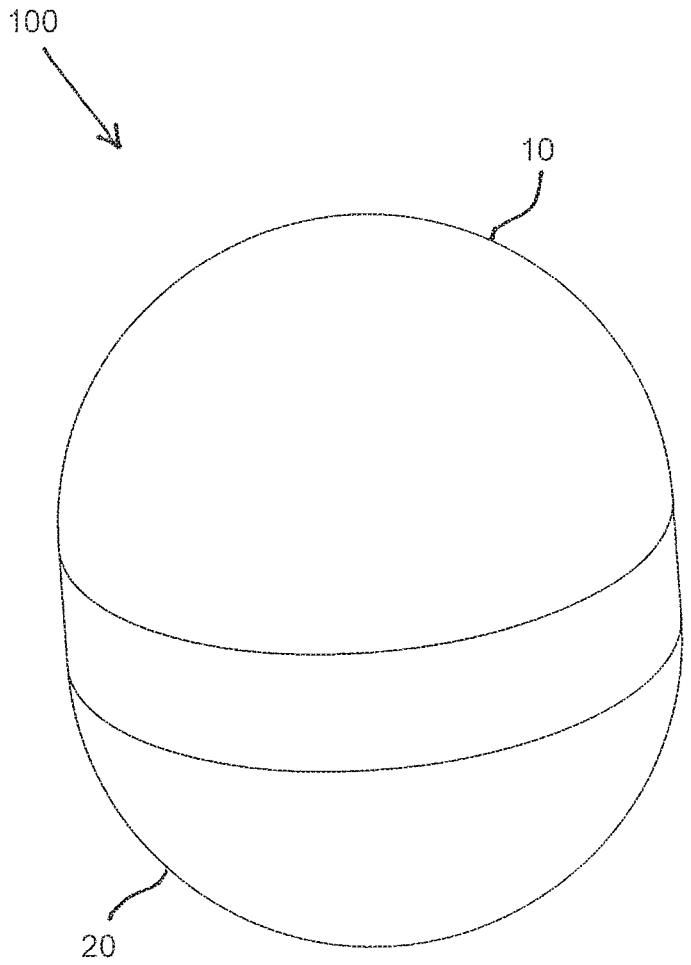
FIG. 1 is a perspective view of a cosmetic container according to a first embodiment of the present disclosure.
Figure 2:
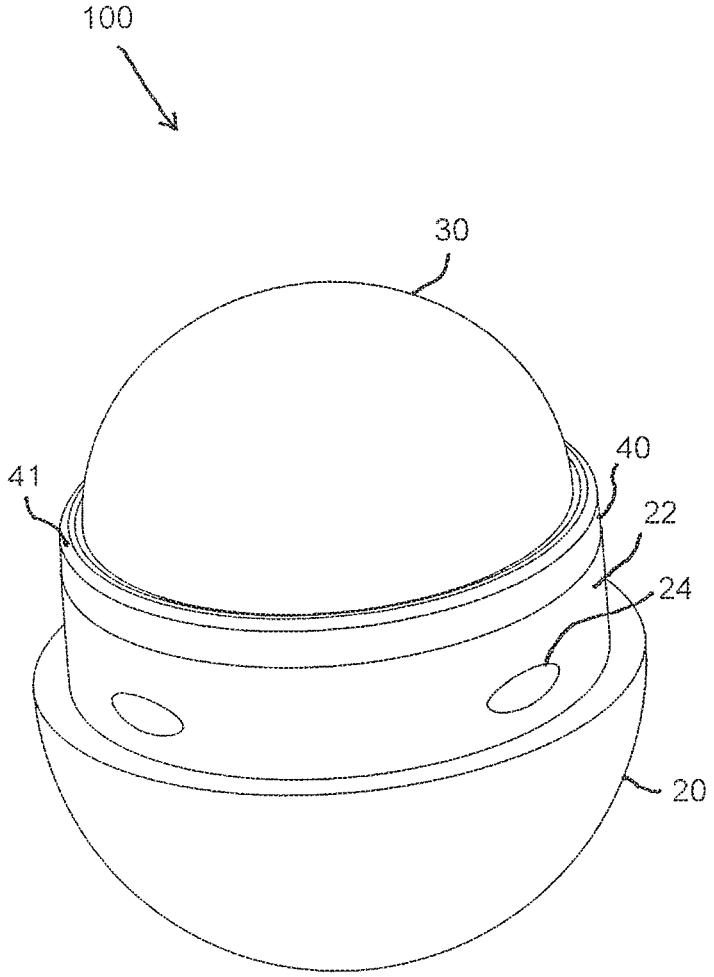
FIG. 2 is a perspective view of the cosmetic container of FIG. 1 with cap removed.

To facilitate understanding, identical reference numerals have been used, where possible, to designate identical elements that are common to the Figures. It is to be noted, however, that the appended drawings illustrate only typical embodiments of this disclosure and are therefore not to be considered limiting of its scope, for the disclosure may admit to other equally effective embodiments.

Figure 3:
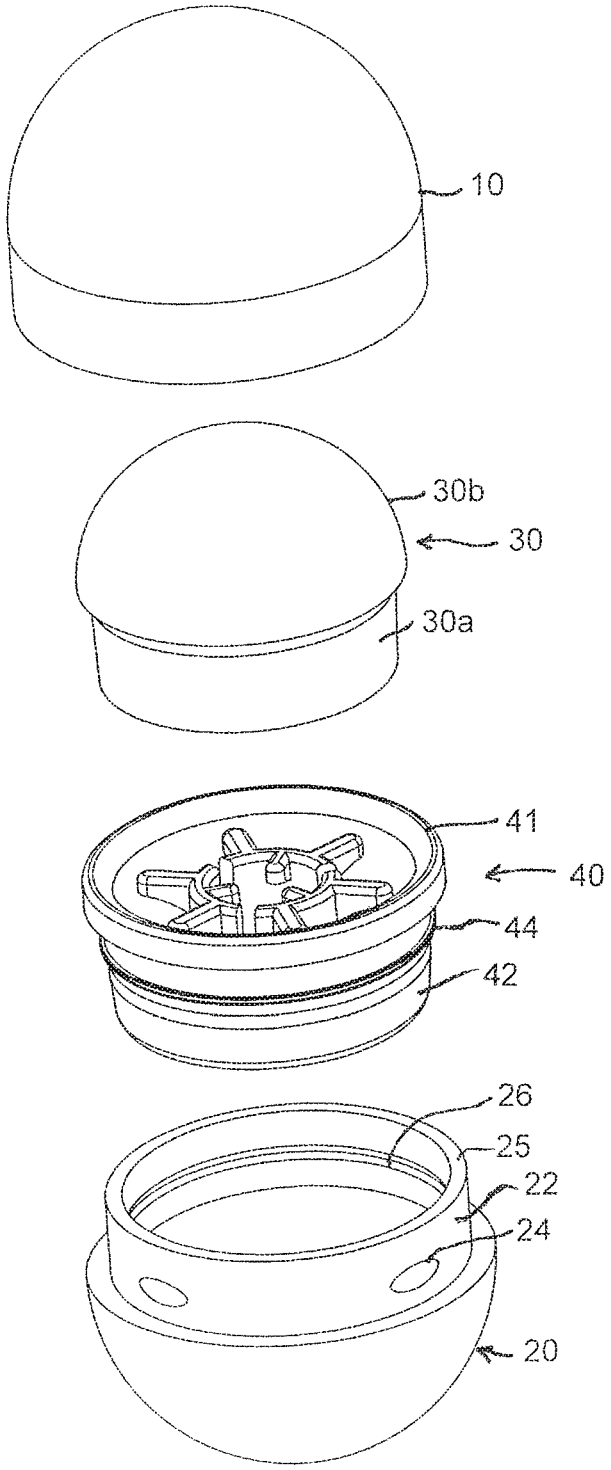
FIG. 3 is an exploded view of the cosmetic container of FIG. 1.
Figure 4:
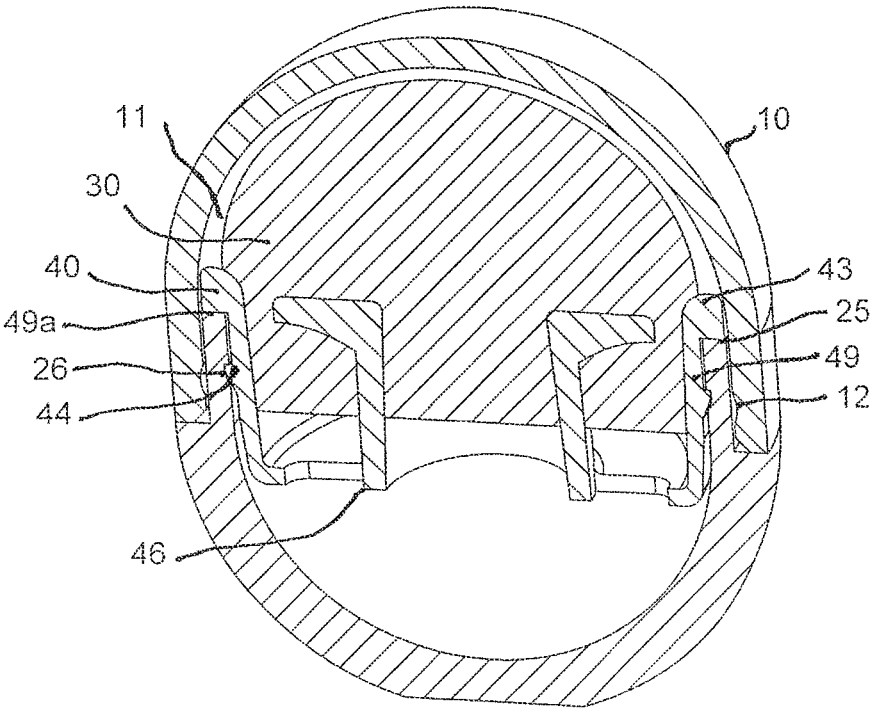
FIG. 4 is a cross sectional view of the cosmetic container of FIG. 1.

A cosmetic container 100 in accordance with the present disclosure is shown in FIGS. 1-4. The cosmetic container 100 comprises a cap 10 and a base 20. A cosmetic product 30 is located in the base 20. The cosmetic product 30 is a solid cosmetic product, for example a lip balm, a cheek rouge or the like. The term "solid cosmetic product" as used herein includes a solid or semi-solid product, for example lip balm, cheek rouge or the like which can be used for cosmetic or care applications. The cap 10 covers an upper portion of the base 20 in such a manner as to cover the cosmetic product 30 and a product holder 40 holding the cosmetic product 30, as shown in FIGS. 3 and 4. Upon opening of the cosmetic container 100, the cosmetic product 30 is revealed.

Figure 12:
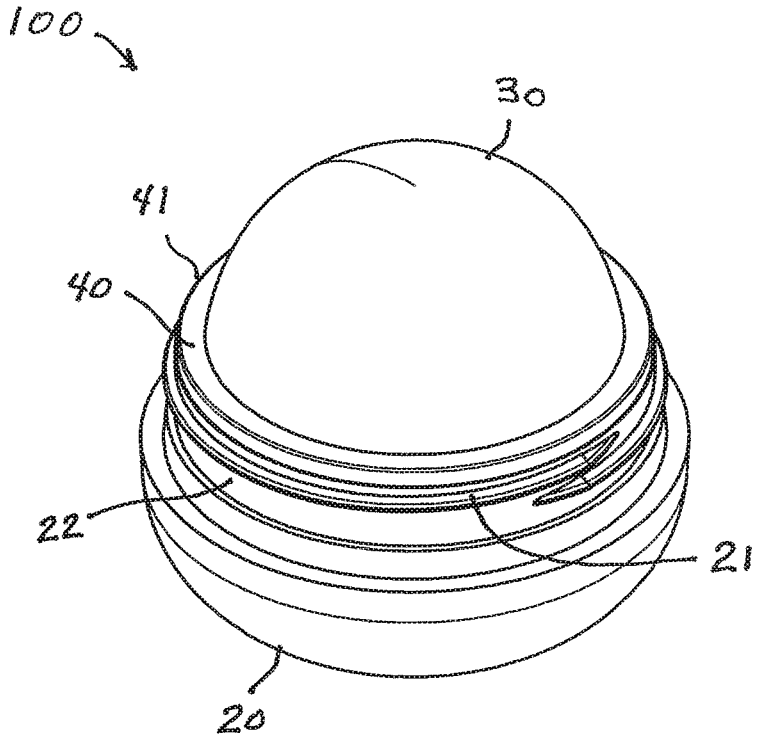
FIG. 12 is a perspective view of the cosmetic container of FIG. 11 with cap removed.
Figure 13:
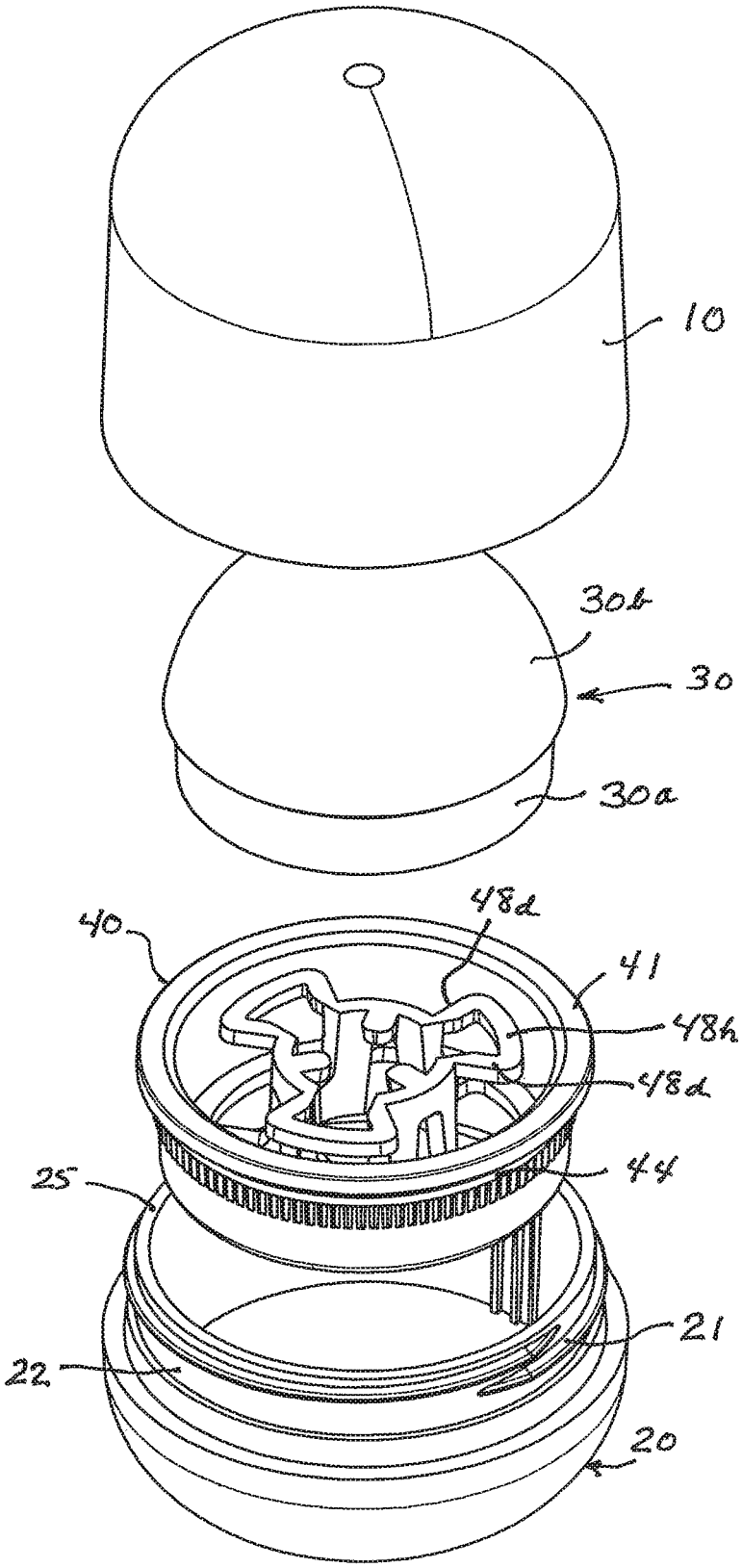
FIG. 13 is an exploded view of the cosmetic container of FIG. 11.
Figure 14:
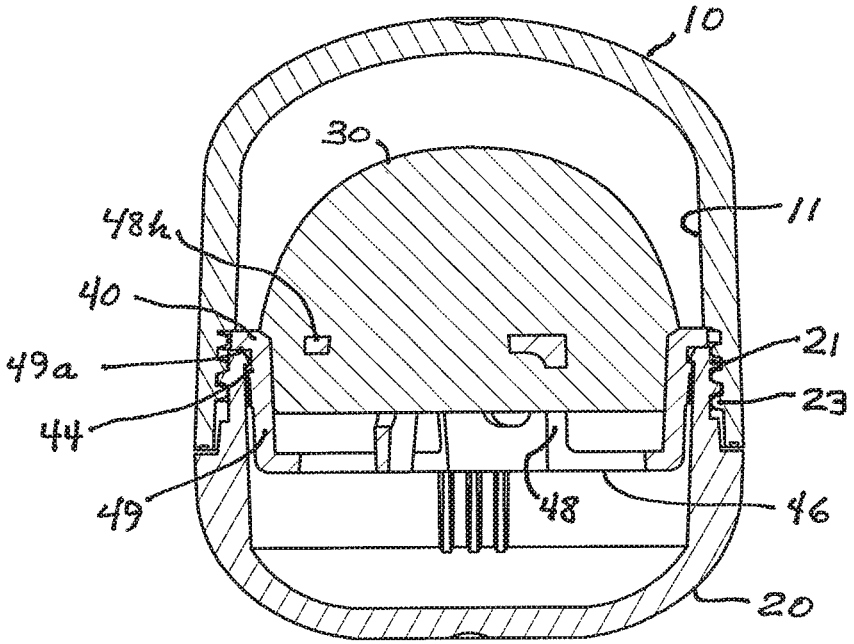
FIG. 14 is a cross sectional view of the cosmetic container of FIG. 11.

The cap 10 and the base 20 are preferably connectable together by screw threads (as shown in FIGS. 12-14, described below), although other suitable means such as a snap fitment, or any other means known in the art may be used. According to another embodiment, the cap 10 and the base 20 may be connected by a hinge. In an alternative shown in FIGS. 2-4, a neck 22 of the base 20 has external protrusions 24 for attachment of the cap 10 by cooperating with circumferential groove 12 provided in an interior surface 11 of the cap 10.

According to an aspect of the present disclosure, the cosmetic product 30 is mounted in the base 20 on the product holder 40 and the cosmetic product 30 is configured to have a dome shape. The dome shape allows the cosmetic product 30 to extend above the upper edge 41 of the product holder 40, thereby facilitating the uninhibited application of the cosmetic product 30 when the holder 40 is mounted in the upper portion of the base 20. More particularly, the cosmetic product 30 is structured, as shown in FIG. 3, so as to have an approximately cylindrical lower portion 30*a* and a dome-shaped convex portion 30*b* bulging upward from the lower portion 30*a*. The present disclosure is not limited to the cosmetic product 30 being configured to have a dome shape, however, as other configurations which allow the cosmetic product 30 to extend above the upper edge 41 of the product holder 40 are also within the scope of the present disclosure.

Referring now to FIGS. 4-7, the product holder 40 has a cylindrical outer hollow body 42 and a cantilevered member 46. The outer hollow body 42 has an upper end 42*a* and a lower end 42*b*, and an external engagement feature is located on an exterior surface of the outer hollow body 42 to facilitate the connection of the product holder 40 to an interior connecting structure such as an annular groove 26 in the interior of the base 20. In the assembly of the cosmetic container 100, the external engagement feature (i.e. a circumferential projection 44) allows the product holder 40 to be snapped in the base 20. According to a further aspect of the present disclosure, the circumferential projection 44 is present on the contracted bottom mounting portion 49. According to the present embodiment, the circumferential projection 44 is present on a middle portion of the outer surface of the outer hollow body 42. In alternative embodiments, the circumferential projection may be located at any point along the length of the outer hollow body.

According to an embodiment, the contracted bottom mounting portion 49 may also comprise at least one cut out (not shown) for providing flexibility to the contracted bottom mounting portion 49 so that the product holder 40 can be easily fitted into the base 20.

According to a further aspect of the present disclosure, as shown in FIGS. 5-7, the outer hollow body 42 is a stepped cylinder having an opening 45, an upper rim 43, a contracted bottom mounting portion 49 axially disposed below the upper rim 43 and a bonding face 49*a* transversely disposed at the top side of the contracted bottom mounting portion 49. The upper rim 43 has an outer diameter equal to an outer diameter of the neck 22 of the base 20 and the contracted bottom mounting portion 49 has an outer diameter less than the inner diameter of the neck 22 of the base 20. Therefore, during mounting of the product holder 40 in the base 20, the contracted bottom mounting portion 49 is inserted into the base 20 and the bonding face 49*a* is stopped on an upper edge 25 of the neck 22 of the base 20 so that the upper rim 43 is seated on the edge 25 of the base 20 (shown in FIG. 4).

According to a further aspect of the present disclosure, at least a portion of the cantilevered member 46 is arranged in an inner side of outer hollow body 42. More particularly, the cantilevered member 46 extends from the lower end 42*b* of the outer hollow body 42 into a space surrounded/enclosed by the outer hollow body 42. The cantilevered member 46 includes a hollow holder portion 48 and at least one connecting portion 47 arranged in a lower side of the outer hollow body 42 for connecting the outer hollow body 42 to the hollow holder portion 48. More particularly, the at least one connecting portion 47 has one end connected to the lower end 42*b* of the outer hollow body 42 and another end connected to an open bottom end 48*b* of the hollow holder portion 48. Further, the at least one connecting portion 47 extends from at least a portion of the circumference of the lower end 42*b* of the outer hollow body 42. According to yet another aspect of the present disclosure, two successive connecting portions 47 define an aperture 50 between them.

In another embodiment, the at least one connecting portion has lattice or mesh like structure having rigidity.

Further, the hollow holder portion 48 of the cantilevered member 46 is coaxial with the outer hollow body 42 and holds the cosmetic product 30. The hollow holder portion 48 has an open top end 48*a* and an open bottom end 48*b* constituting a passage 48*c* which is set as a filling port into which a liquefied cosmetic product is poured, as will be explained in detail later. Further, the hollow holder portion 48 includes a plurality of projections 48*d* projecting from the outer surface of an upper portion of the hollow holder portion 48. The plural projections 48*d* project radially from the outer surface of the upper portion of the hollow holder portion 48 but in other embodiments they may project in a non-radial manner. The plural projections 48*d* extend from the hollow holder portion 48 towards the inner surface of the outer hollow body 42 but they do not connect with or abut the inner surface of the outer hollow body 42. As shown, both the plurality of projections 48*d* and the hollow holder portion 48 are structured to support/hold the cosmetic product 30 (see FIG. 4), and they prevent cracking or chipping of the cosmetic product or prevent breaking away of the cosmetic product from the container 100 when an external force, for example, an impact due to a drop or the like, or a vibration or the like, is applied to the cosmetic container 100.

Further, the hollow holder portion 48 of the cantilevered member 46 has at least one axial slit 48*f* and at least one projection 48*g* extending from the inner surface of the hollow holder portion 48. The at least one axial slit 48*f* provides free flow of liquefied phase of the cosmetic product during a hot pour process and the at least one projection 48*g* provides better anchoring of the cosmetic product 30 with the product holder 40.

The present disclosure is not limited in regard to the shape of the cosmetic container 100, as the cosmetic container 100 may be substantially cylindrical with rounded surfaces, egg-shaped, ovate, polygonal or the like. In the present embodiment, the cosmetic container comprises a cap and a base each having a substantially semi-spherical shape; therefore, the cosmetic container appears substantially spherical in shape.

Figure 8:
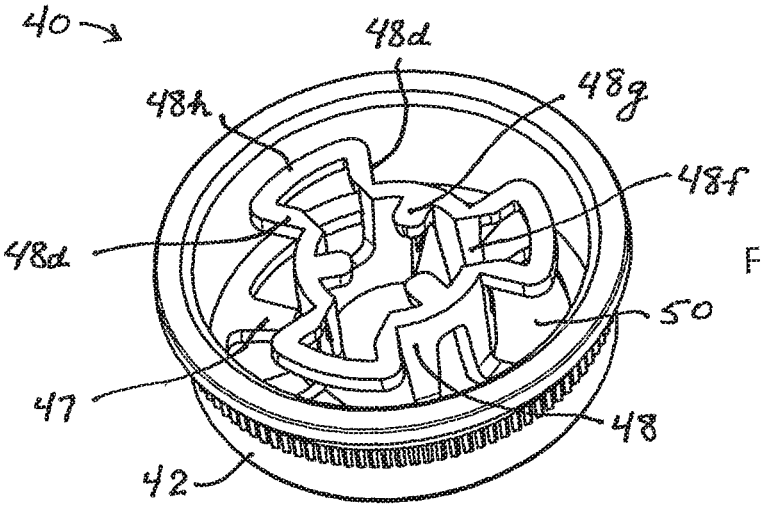
FIG. 8 is a perspective view of a product holder according to a second embodiment.
Figure 9:
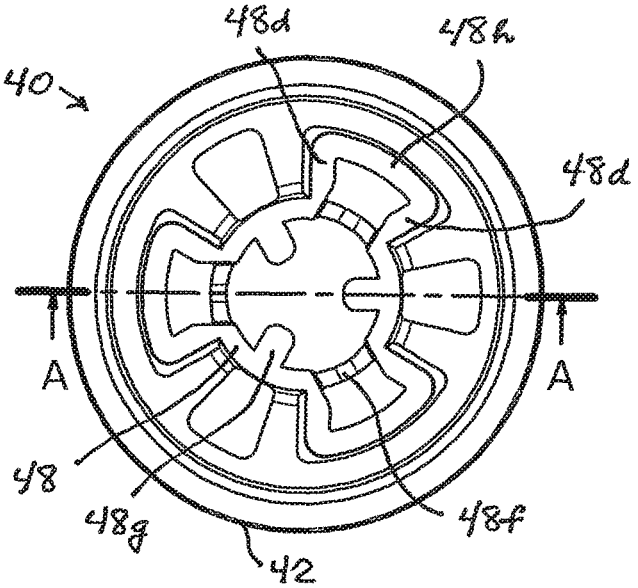
FIG. 9 is a top view of the product holder of FIG. 8.
Figure 10:
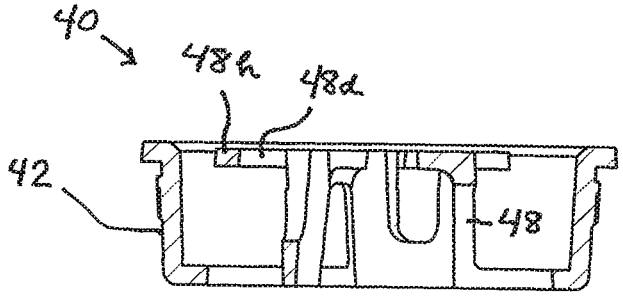
FIG. 10 is a cross sectional view of the product holder along line A-A of FIG. 9.
Figure 11:
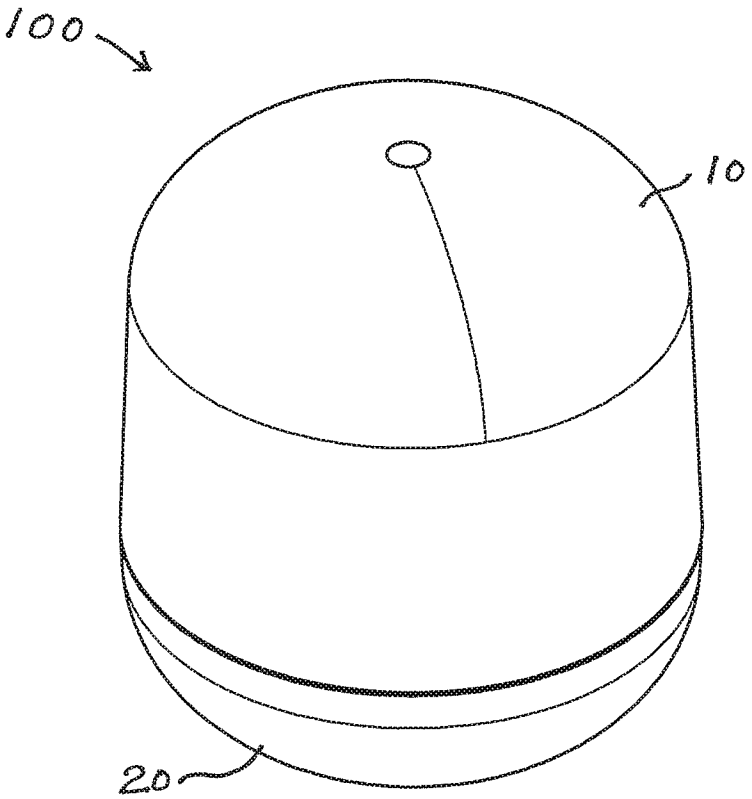
FIG. 11 is a perspective view of a cosmetic container according to a preferred embodiment of the present disclosure.

FIGS. 8-10 are a perspective view, top view and cross-sectional view respectively of a product holder according to a second embodiment of the present disclosure. The product holder 40 of FIGS. 8-10 is similar to the product holder 40 of FIGS. 5-7 but differs in some respects as will now be explained. In particular, the at least two projections 48*d* extending from the outer surface of the hollow holder portion 48 are connected by a connecting member 48*h* which further improves anchoring of the cosmetic product 30 with the product holder 40.

A further, and currently preferred, embodiment of a cosmetic container in accordance with the present disclosure is shown in FIGS. 11-14, wherein the cosmetic container 100 again comprises a cap 10 and a base 20, with a solid cosmetic product 30 located in the base 20. As before, the cap 10 covers an upper portion of the base 20 so as to cover the cosmetic product 30 and a product holder 40 holding the cosmetic product 30, such that upon opening of the cosmetic container 100, the cosmetic product 30 is revealed. This embodiment is generally similar to that of FIGS. 1-4 except in external configuration and in respects now to be explained. In particular, the product holder 40 has the structure shown in FIGS. 8-10 (described above), and the cap 10 and the base 20 are connectable together by screw threads 21 and 23 respectively provided on neck 22 of the base 20 and on interior surface 11 of the cap 10.

Figure 15A:
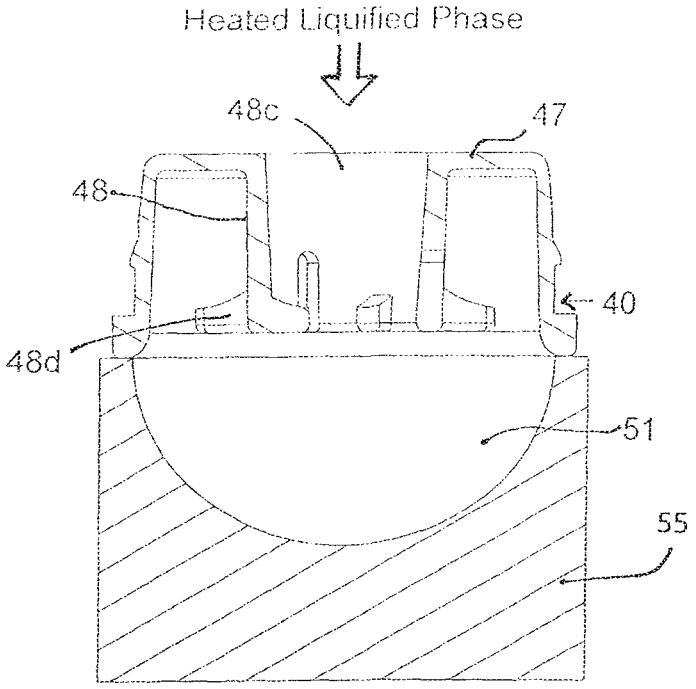
FIGS. 15A-15D are sectional elevational views illustrating a method of manufacturing a solid cosmetic product of the present disclosure using a hot pour process.
Figure 15B:
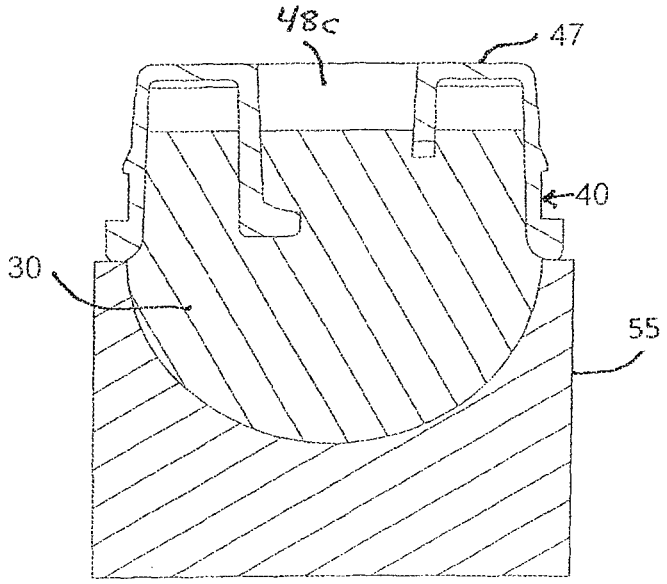
Figure 15C:
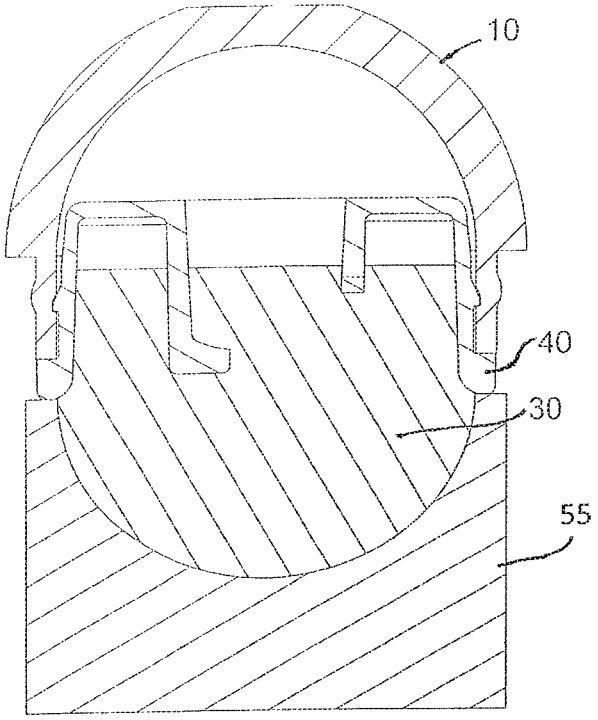
Figure 15D:
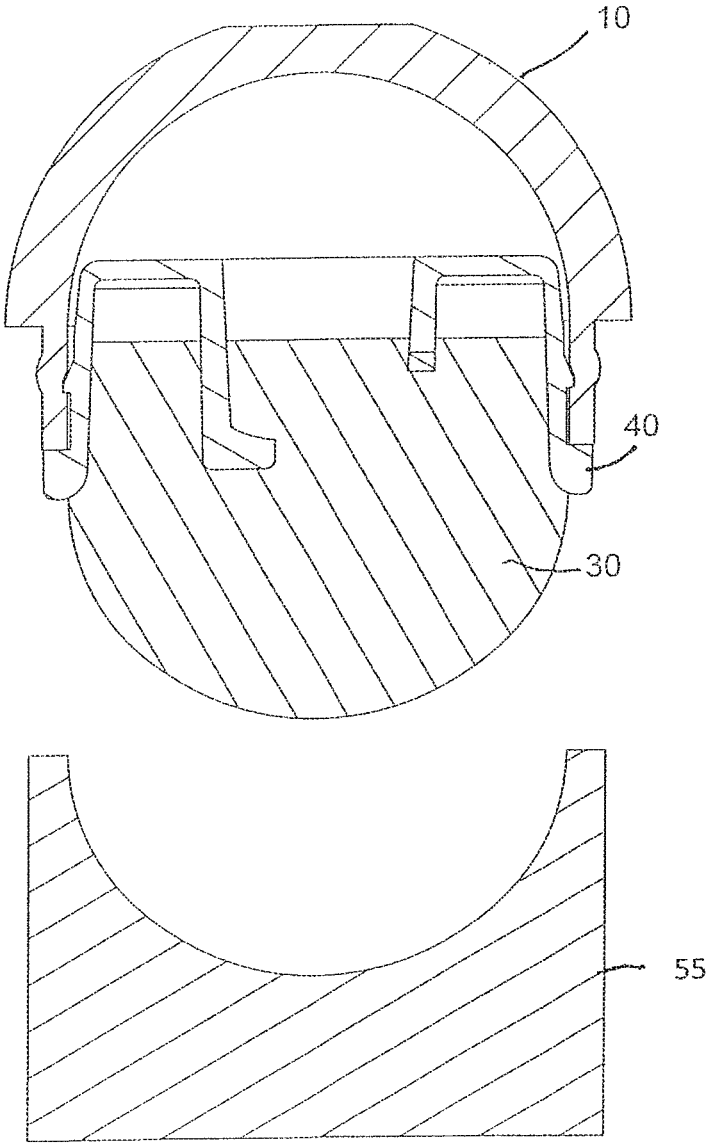

Referring now to FIGS. 15A-15D, the cosmetic product 30 held by the product holder 40 is manufactured using a hot pour process. In use of the hot pour process, cosmetic ingredients are combined and heated to form a liquefied phase and poured into a mold 55 having a cavity 51 which is shaped to provide a desired outer shape of the molded cosmetic product 30. In the hot pour process, the product holder 40 is inverted and fitted to the mold 55. The product holder 40 is level and vertical with regard to the mold 55 as shown in FIG. 15A. The heated and liquefied phase is poured into the product holder 40, preferably through the opening 48*c* (filling port) of the hollow holder portion 48 from a filling nozzle (not shown) arranged on an upper side of the mold, until the mold is filled to a level to cover the plurality of projections 48*d* and at least a portion of the hollow holder portion 48, and not to contact the connecting portion 47 of the cantilevered member 46 as shown in FIG. 15B. The liquefied phase is cooled or allowed to cool. Upon sufficient solidification of the liquefied phase, the base 20 is fitted onto the product holder 40 as shown in FIG. 15C. Alternatively, the base 20 is fitted onto the product holder 40 when the cosmetic product is still in liquefied phase. Finally, when the cosmetic product is solidified, the mold 55 is released as shown in FIG. 15D, whereby cosmetic product 30 is supported by the product holder 40.

Figure 16:
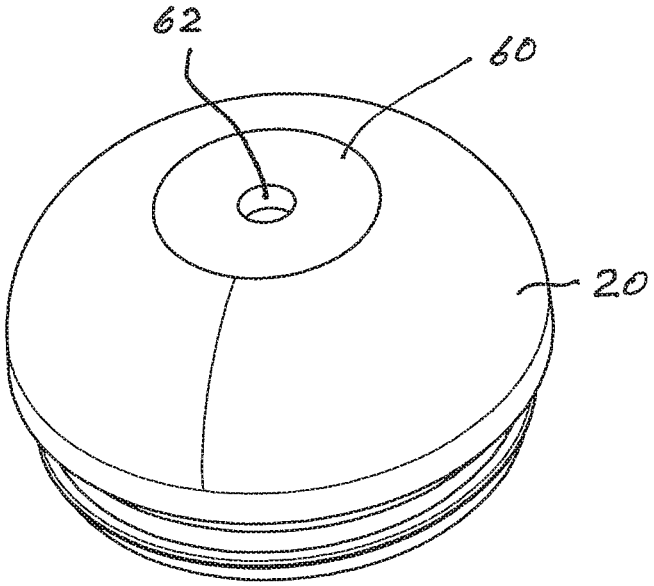
FIG. 16 is a perspective view of the bottom of the base of a cosmetic container according to a further embodiment.

In another alternative, illustrated in FIG. 16, the base 20 has a bottom 60 formed with a hole 62 positioned for register with the filling port defined by the hollow holder portion when the product holder is mounted in the base, so that the base and product holder can be assembled together prior to hot pour molding of a cosmetic product. The liquefied phase cosmetic product is then poured into the filling port through the hole 62 in the base.

Figure 17:
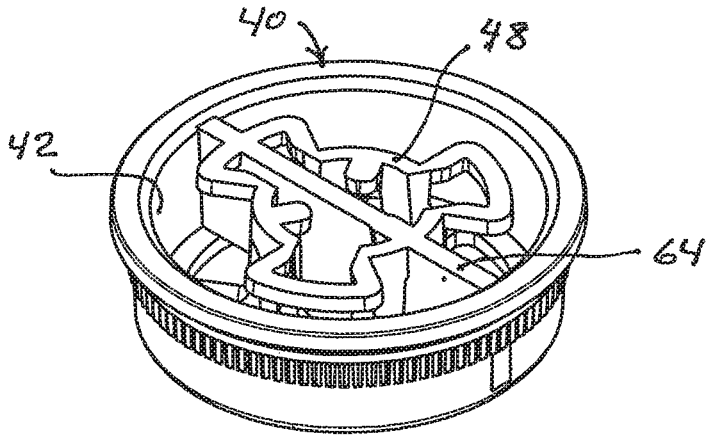
FIG. 17 is a perspective view of a product holder according to yet another embodiment.

In a still further alternative, shown in FIG. 17, at least one dividing wall 64 extends transversely through the product holder 40 to divide the space enclosed by the outer hollow body 42, including the hollow holder portion 48 and the filling port it defines, into at least two regions for enabling more than one product to be filled and molded, by pouring different products in liquefied phase respectively into the thus-divided regions of the filling port.

The plurality of projections 48*d*, 48*g* and the connecting member 48*h* provide surfaces onto which the solidified cosmetic product 30 can adhere. Further, the product holder 40 is coupled to the base 20 so as to be immobile in an axial direction.

When the cosmetic container 100 structured in the manner mentioned above is provided for use, it may be used by detaching the cap 10 from the base 20, holding the outer peripheral surface of the base 20 and applying the dome-shaped convex portion of the cosmetic product 30 to the skin. According to an alternative embodiment not shown, the cap 10 may be pivoted with respect to the base 20 to open and close the cosmetic container.

According to an aspect of the present disclosure, the cap 10, the base 20, and product holder 30 are constituted by plastic, glass, metal or any other material known in the art.

It is to be understood that the invention is not limited to the features and embodiments hereinabove specifically set forth, but may be carried out in other ways without departure from its spirit.

What is claimed is:

1. A cosmetic container comprising a product holder holding a solid cosmetic product in a base of the cosmetic container, the product holder comprising an outer hollow body with as open upper end and a lower end; and a cantilevered member;

wherein at least a portion of the cantilevered member is arranged in an inner side of the outer hollow body;

wherein the cantilevered member comprises at least one connecting portion, and a hollow holder portion;

wherein the at least one connecting portion has one end connected to an open bottom end of the hollow holder portion and a second end connected to the outer hollow body; and wherein the hollow holder portion comprises a plurality of projections projecting from an outer surface of the hollow holder portion.

2. The cosmetic container of claim 1, wherein the outer hollow body is cylindrical in shape.

3. The cosmetic container of claim 1, wherein the cantilevered member extends from the lower end of the outer hollow body into a space enclosed by an inner surface of the outer hollow body.

4. The cosmetic container of claim 1, wherein the hollow holder portion is coaxial with the outer hollow body.

5. The cosmetic container of claim 1, wherein the second end of at least one connecting portion is connected to the lower end of the outer hollow body.

6. The cosmetic container of claim 1, wherein the at least one connecting portion extends from at least a portion of the circumference of the lower end of the outer hollow body.

7. The cosmetic container of claim 1, wherein the hollow holder portion of the cantilevered member has at least one axial slit.

8. The cosmetic container of claim 1, wherein the plurality of projections do not abut an inner surface of the outer hollow body.

9. The cosmetic container of claim 1, wherein the outer hollow body is a stepped cylinder comprising an opening, an upper rim, and a contracted bottom mounting portion axially disposed below the upper rim.

10. The cosmetic container of claim 9, wherein a bonding face is transversely disposed at a top side of the contracted bottom mounting portion.

11. The cosmetic container of claim 10, wherein the upper rim has an outer diameter equal to an outer diameter of a neck of the base of the container whereas the contracted bottom mounting portion has an outer diameter less than an inner diameter of the neck of the base.

12. The cosmetic container of claim 11, wherein during mounting of the product holder in the base, the contracted bottom mounting portion is inserted into the base while the transverse bonding face is stopped on an upper edge of the neck of the base so that the upper rim is seated on the edge of the base.

13. The cosmetic container of claim 1, wherein an external engagement feature on an exterior surface of the outer hollow body is provided for engagement with the base.

14. The cosmetic container of claim 1, wherein free ends of at least two pro ections extending from the outer surface of the hollow holder portion are connected by a connecting member.

15. The cosmetic container of claim 1, wherein the base is connected to a cap by screw threads.

16. The cosmetic container of claim 1, wherein the cosmetic container is of a shape selected from the group consisting of cylindrical with rounded surfaces, egg-shaped, ovate and polygonal.

17. The cosmetic container of claim 1, wherein the hollow holder portion has an open top end and an open bottom end constituting a passage which serves as a filling port into which a liquefied cosmetic product is poured when the product holder is inverted and fitted to a mold for hot pour molding of a solid cosmetic product.

18. The cosmetic container of claim 17, wherein the base has a bottom form with a hole positioned to register with the filling port when the product holder is mounted in the base such that the base and product holder can be assembled together prior to hot pour molding of a solid cosmetic product.

19. The cosmetic container of claim 17, wherein at least one dividing wall extends transversely through the product holder to divide the product holder, including the hollow holder portion and the filling port it defines, into separate regions for enabling more than one product to be filled and molded.

20. A cosmetic container comprising a product holder holding a solid cosmetic product in a base of the cosmetic container, the product holder comprising an outer hollow body with an open upper end and a lower end; and a cantilevered member;

wherein at least a portion of the cantilevered member is arranged in an inner side of the outer hollow body;

wherein the cantilevered member comprises at least one connecting portion, anti a hollow holder portion;

wherein the at least one connecting portion has one end connected to an open bottom end of the hollow holder portion and another end connected to the outer hollow body; and wherein at least one projection extends from an inner surface of the hollow holder portion.

21. The cosmetic container of claim 20, wherein the hollow holder portion of the cantilevered member has at least one axial slit.

22. A cosmetic container comprising a product holder holding solid cosmetic product in a base of the cosmetic container, the product holder comprising an outer hollow body with an open upper end and a lower end; and a cantilevered member;

wherein at least a portion of the cantilevered member is arranged in an inner side outer hollow body;

wherein the cantilevered member comprises at least one connecting portion, and a hollow holder portion;

herein the at least one connecting portion has one end connected to an open bottom end of the hollow holder portion and another end connected to the outer hollow body;

wherein the hollow holder portion comprises a plurality of projections projecting from an outer surface of the hollow holder portion;

wherein the solid cosmetic product contacts the plurality of projections and at least a portion of the hollow holder portion; and wherein the solid cosmetic product does not contact the connecting portion of the cantilevered member.

23. The cosmetic container of claim 22, wherein cosmetic product has a shape which allows the cosmetic product to extend above an upper edge of the product holder.

* * * * *